US006660954B2

(12) United States Patent
Iwabuchi et al.

(10) Patent No.: US 6,660,954 B2
(45) Date of Patent: Dec. 9, 2003

(54) GAS-BLAST CIRCUIT-BREAKER

(75) Inventors: Kenji Iwabuchi, Hitachinaka (JP); Manabu Takamoto, Hitachi (JP); Naoyuki Yamamoto, Hitachi (JP); Masahiro Yaegashi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/247,345

(22) Filed: Sep. 20, 2002

(65) Prior Publication Data

US 2003/0127430 A1 Jul. 10, 2003

(51) Int. Cl.[7] ..... H01H 9/34
(52) U.S. Cl. ..... 218/52; 218/51; 218/59
(58) Field of Search ..... 218/51, 52, 53, 218/57–64, 76, 77, 136, 156–158

(56) References Cited

U.S. PATENT DOCUMENTS

| | | | | | |
|---|---|---|---|---|---|
| 4,459,447 | A | * | 7/1984 | Arimoto | 218/56 |
| 4,467,158 | A | * | 8/1984 | Kobayashi et al. | 218/57 |
| 5,079,392 | A | * | 1/1992 | Tsukushi et al. | 218/59 |
| 5,229,561 | A | * | 7/1993 | Seki et al. | 218/62 |
| 5,793,597 | A | * | 8/1998 | Mizufune et al. | 218/52 |
| 5,814,781 | A | * | 9/1998 | Koyanagi et al. | 218/60 |
| 5,850,065 | A | * | 12/1998 | Yaginuma et al. | 218/76 |

FOREIGN PATENT DOCUMENTS

| | | |
|---|---|---|
| JP | 06-150520 | 8/1985 |
| JP | 61-127542 | 6/1986 |
| JP | 01-134829 | 5/1989 |
| JP | 01-195149 | 8/1989 |
| JP | 08-195147 | 7/1996 |
| JP | 08-195149 | 7/1996 |

* cited by examiner

*Primary Examiner*—Elvin Enad
*Assistant Examiner*—M. Fishman
(74) *Attorney, Agent, or Firm*—Mattingly, Stanger & Malur, P.C.

(57) ABSTRACT

The gas-blasted circuit-breaker includes a movable arc contact, a fixed arc contact opposing the movable arc contact, an insulating nozzle, a puffer cylinder, a hollow conductor, an insulating rod connected to the puffer cylinder, and a fixed piston fitted inside the puffer cylinder. An insulating gas is ejected to a space between the puffer cylinder and the fixed piston by driving the insulating rod and is sprayed to an arc generated upon interruption of a current. The hollow conductor is in a cylindrical shape having a cross section parallel to the axis thereof. The cross section is smaller in diameter on the downstream side of a flow of insulating gas. The hollow conductor has a closed end on the downstream side of the flow of insulating gas and has a cylindrical barrel portion provided with a plurality of opening. With this configuration, this circuit-breaker ensures an operation of adjusting the flow of a heat gas, cooling of the heat gas and insulating performance for the fixed conductor to which the heat gas is sprayed.

7 Claims, 5 Drawing Sheets

GAS-BLAST CIRCUIT-BREAKER

BACKGROUND OF THE INVENTION

The present invention relates to a novel gas-blast circuit-breakers having a conductor structure suitable for heat gas flow treatment.

In general, gas-blast circuit-breakers include an arc-extinctive chamber disposed in an insulating gas, an operating mechanism for operating a mover disposed within the arc-extinctive chamber, and an operating device using a hydraulic pressure or the like; the arc-extinctive chamber has a fixed contact, a movable contact, an insulating nozzle, a puffer cylinder, a piston, and a shield for buffering an electric field. These are disclosed for example in Japanese Patent Laid-open Nos. 8-195147, and 8-195149.

Conventional gas-blast circuit-breakers include an arc-extinctive chamber, a fixed contact, a movable contact, an insulating nozzle, a puffer cylinder, an insulating rod, a piston, and an operating device that drives the insulating rod. The movable contact disposed in the arc-extinctive chamber is coupled to the operating device by way of the insulating rod, a pin and a lever so as to open/close the circuit-breaker. In the circuit-breaker having such a structure, a fixed conductor having the fixed contact secured thereto is formed of a straight hollow conductor having a plurality of openings. With this configuration, in a case of interrupting a large current such as a rated interrupting current, an insulating gas that is sprayed to an arc generated between poles is heated with this arc to be brought to high temperatures. Since the high temperature heat gas deteriorates dielectric strength, heat gas treatment is one of critical factors in exploiting sufficient performance of the circuit-breaker.

To suppress the effect of ground and pole-to-pole insulation reductions due to the above stated heat gas, the conventional circuit-breakers have employed a method of enlarging a tank diameter so as to extend a ground insulation distance, or a method of increasing an operating speed of an insulating unit by raise an operating force so as to extend the pole-to-pole insulation distance at the time of interruption; however, this poses a problem regarding the size reduction of circuit-breakers.

SUMMARY OF THE INVENTION

It is an object of the present invention to provide a gas-blasted circuit-breaker provided with a shield that is most suitable in terms of an operation of adjusting a flow of heat gas, a cooling effect of the heat gas, and insulating performance for a fixed conductor to which the heat gas is sprayed.

According to an aspect of the present invention, there is provided a gas-blasted circuit-breaker including a movable arc contact; a fixed arc contact opposed to the movable arc contact; an insulating nozzle disposed at the movable arc contact on the fixed arc contact side thereof; a puffer cylinder disposed on the side opposite to the insulating nozzle; a hollow conductor that holds the fixed arc contact opposed to the insulating nozzle; an insulating rod connected to the puffer cylinder; and a fixed piston fitted inside the puffer cylinder; wherein an insulating gas is ejected to a space between the puffer cylinder and the fixed piston by driving the insulating rod and is sprayed to an arc generated upon interruption of a current; and wherein the hollow conductor is in a cylindrical shape having a cross section parallel to the axis thereof, the cross section being smaller in diameter on the downstream side of a flow of insulating gas, the hollow conductor having a closed end on the downstream side of the flow of insulating gas, and the hollow conductor has a cylindrical barrel portion provided with a plurality of openings.

Preferably, the cylindrical barrel portion has three stages of an upstream part, an intermediate part, and a downstream part with respect to the flow of insulating gas in a cross-section parallel to the axis thereof, and the intermediate part is made progressively smaller toward the downstream side thereof and is provided with the openings.

According to another aspect of the present invention, there is provided a gas-blasted circuit-breaker including a movable arc contact; a fixed arc contact opposed to the movable arc contact; an insulating nozzle disposed at the movable arc contact on the fixed arc contact side thereof; a puffer cylinder disposed on the side opposite to the insulating nozzle; a conductor secured to the fixed arc contact opposed to the insulating nozzle; an insulating rod connected to the puffer cylinder; and a fixed piston fitted inside the puffer cylinder; wherein an insulating gas is ejected to a space between the puffer cylinder and the fixed piston by driving the insulating rod and is sprayed to an arc generated upon interruption of a current; and wherein the conductor includes a semicylindrical member having an opening on the downstream side of a flow of insulating gas and a cross-section being parallel to the axis of the conductor and being smaller on the downstream side of the flow of insulating gas, and a semicylindrical shield member that is joined to both side portions of the opening side of the semicylindrical member on the side portions of a cylindrical portion in the longitudinal direction on the upstream side of the flow of insulating gas, and the semicylindrical shield member has a shape in which the distal end thereof on the downstream side of the flow of insulating gas is closed.

Preferably, a barrel portion of the semicylindrical member has three stages of an upstream part, an intermediate part and a downstream part, with respect to the flow of insulating gas, in cross-section parallel to the axis thereof, and the intermediate part is smaller in cross-section on the downstream side thereof and is provided with the opening.

Preferably, the semicylindrical shield is joined to the semicylindrical member at the distal end thereof on the downstream side of the flow of insulating gas; the semicylindrical shield member is provided over a portion extending from the fixed side the of semicylindrical member to the intermediate part thereof; and the semicylindrical member has a semispherical distal end on the downstream side of the flow of insulating gas.

According to the present invention, ground and pole-to-pole insulation performance can be assured by efficiently treating the heat gas that contributes to large current interrupting performance, and a breaker tank can be reduced in size and insulation performance can be improved.

BRIEF DESCRIPTION OF THE DRAWINGS

Other objects and advantages of the invention will become apparent from the following description of embodiments with reference to the accompanying drawings in which.

DETAILED DESCRIPTION OF THE PREFERRED EMBODIMENTS

Embodiments of the present invention will be described with reference to the accompanying drawings below.

Embodiment 1

Figure 1:
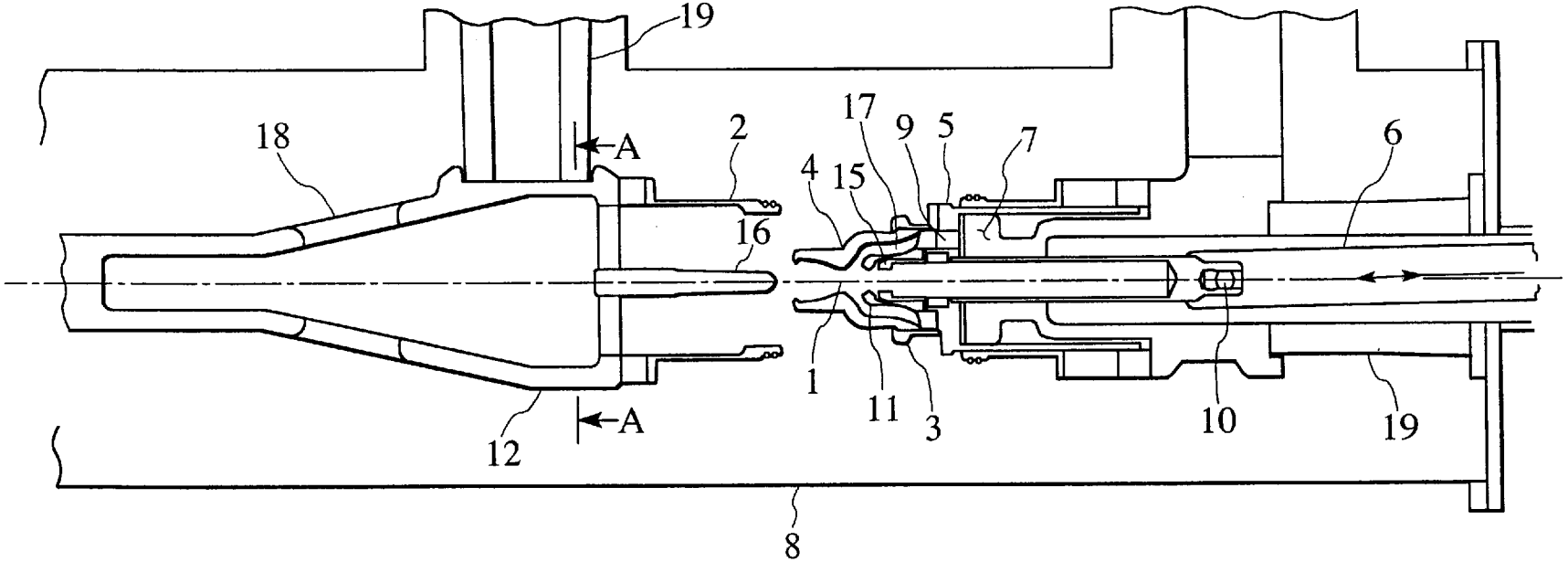
FIG. 1 is a cross sectional view of a gas-blasted circuit-breaker according to a first embodiment of the present invention.
Figure 2:
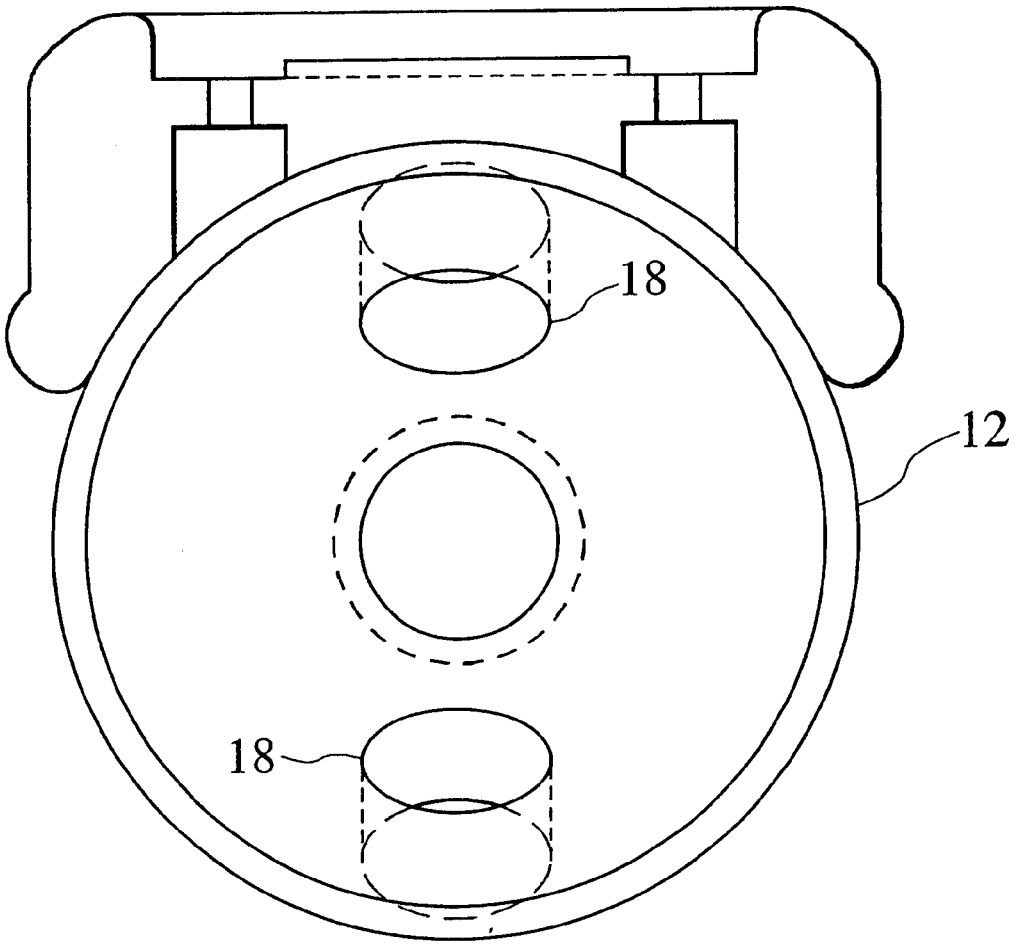
FIG. 2 is a cross sectional view taken along line A—A of FIG. 1.

A gas-blasted circuit-breaker according to a first embodiment of the present invention will be described below. Referring to FIGS. 1 and 2, the gas-blasted circuit-breaker includes an arc-extinct chamber 1, a fixed contact 2, a movable contact 3, an insulating nozzle 4, a puffer cylinder 5, an insulating rod 6, and a piston 7. In addition, the circuit-breaker includes an operating mechanism box and an operating device, both of which are not shown. The movable contact 3 disposed in the arc-extinct chamber 1 is coupled to the operating device by way of the insulating rod 6, a pin 10 and a lever not shown.

As showing in FIG. 1, the fixed conductor 12 is of a cylindrical hollow conductor having a cross section parallel to the axis thereof; this cross section is smaller in diameter on the downstream side of a flow of insulating gas and the conductor is closed at the distal end of the downstream side. In addition, the cylindrical hollow conductor has a barrel portion provided with a plurality of exhaust ports 18. The fixed conductor 12 has the same side view as that shown in FIG. 4 to be described below.

The cylindrical barrel portion has three stages, i.e., an upstream part, an intermediate part, and a downstream part with respect to the flow of insulating gas in a cross-section parallel to the axis thereof. The intermediate part is formed progressively smaller in diameter toward the downstream side thereof and is provided with the exhaust ports 18. On the other hand, the upstream part and the downstream part each have the same diameter.

According to the present embodiment, the fixed conductor 12 is made smaller in diameter on the downstream side of a flow of heat gas so as to prevent the flow of heat gas from diffusing toward ground, and the heat gas is exhausted at the time when it is cooled. This enables an improvement in ground insulation performance, thereby making it possible to enhance large current interrupting performance and reduce the size of a tank.

Embodiment 2

Figure 3:
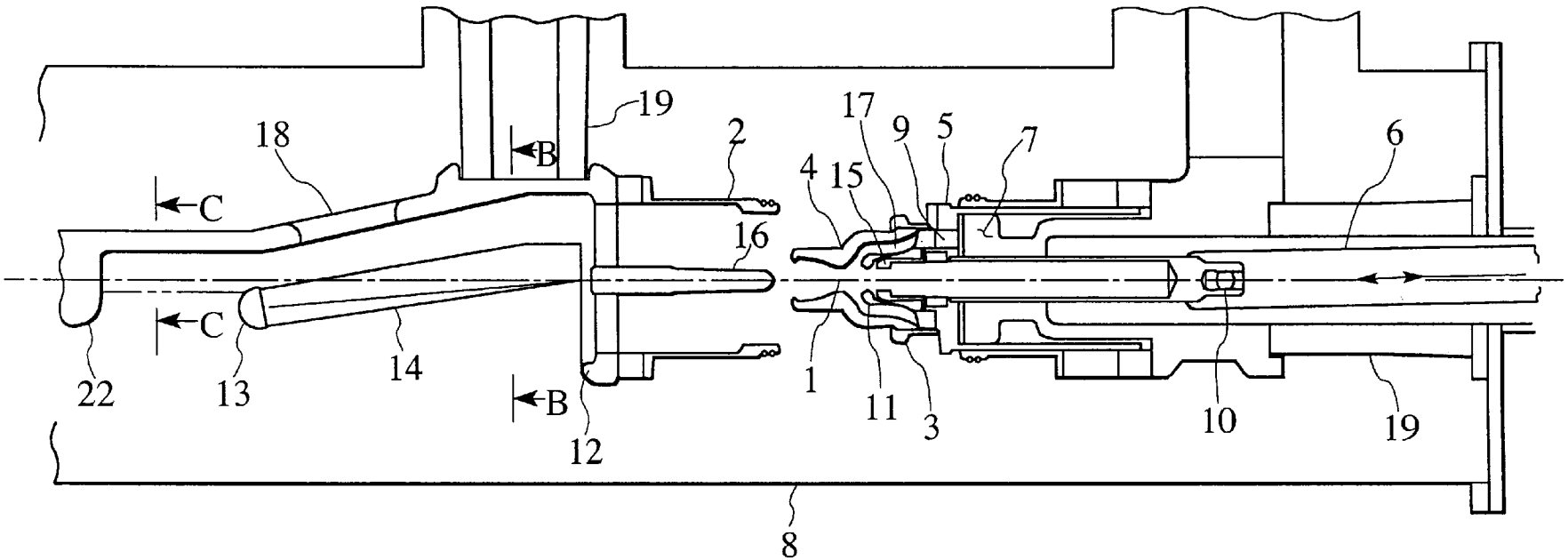
FIG. 3 is a cross sectional view of a gas-blasted circuit-breaker according to a second embodiment of the present invention.

A gas-blasted circuit-breaker according to a second embodiment of the present invention will be described below. Referring to FIG. 3, the gas-blast circuit-breaker has an insulating gas such as a $SF_6$ gas filled inside a gas reservoir or tank 8 and is supported by an insulating support cylinder 19. In addition, this circuit-breaker is provided with an operating mechanism, not shown, and an insulating rod 6 coupled to the operating mechanism. The operating mechanism is operated to allow the insulating rod 6 to slide in the directions of arrows, so that the puffer cylinder 5 coupled to the insulating rod 6 slides in the same manner, which causes open/close operations.

The piston 7 is fixedly fitted to the inner circumference of the puffer cylinder 5. When the puffer cylinder 5 slides in the axial direction, a compressed insulating gas is ejected from a plurality of gas supply ports 9. The gas supply ports 9 are bored on the side surface, of the puffer cylinder 5, facing the piston 7 so that a puffer chamber communicates with the insulating nozzle 4. At the time of interrupting operation, the insulating gas ejected from the gas supply ports 9 is sprayed to an arc generated between a fixed arc contact 16 and a movable arc contact 15 through a passage 17 defined between the insulating nozzle 4 and an insulating cover 11. The movable arc contact 15 can be in contact with or remote from the fixed arc contact 16.

The insulating gas that has been sprayed to the arc is brought to high temperature, and flows toward the fixed conductor 12 due to the opening operation of the movable arc contact 15. The fixed conductor 12 is provided with a semicylindrical shield 14 in nearly parallel with the axial direction thereof so as to adjust the flow of heat gas. The fixed conductor 12 also has a semispherical end shield 13 at the end of the semicylindrical shield 14. In addition, the fixed conductor 12 is provided with at least one exhaust port 18 on the side thereof to prevent the heat gas from staying around the end shield, which enables the heat gas to be exhausted from a gas passage of the fixed conductor 12.

Figure 4:
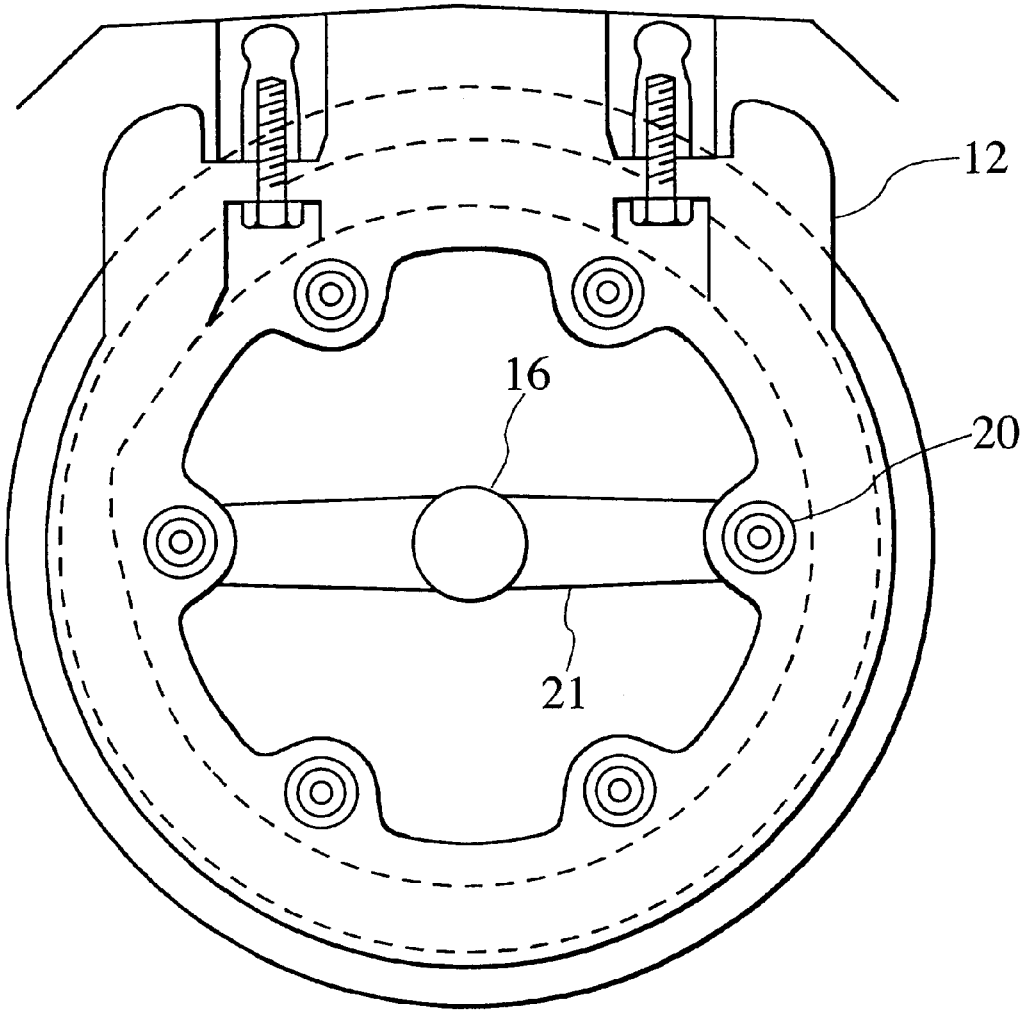
FIG. 4 is a side view of a fixed conductor of FIG. 3, as viewed from a fixed contact side.

FIG. 4 is a side view of the fixed conductor of FIG. 3, as viewed from the side of the fixed contact 16. As shown in FIG. 3, the fixed conductor 12 is cylindrical and a fixed contact 2 is secured onto the fixed conductor 12 with screws 20. A fixed arc contact 16 is in a rod shape and is provided with a threaded part at the mounting portion thereof. The fixed arc contact 16 is connected to the fixed conductor 12 in such a manner that the threaded part of the fixed arc contact 16 is directly screwed into a threaded hole bored in an arm 21, which is formed on the fixed conductor 12.

Figure 5:
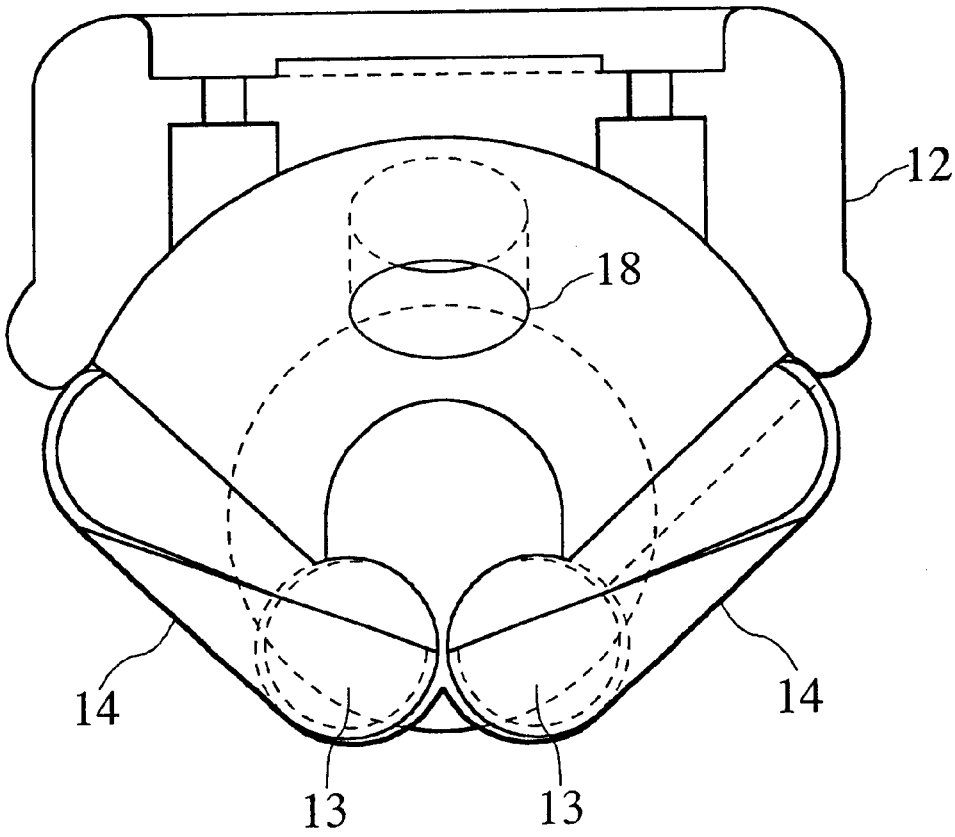
FIG. 5 is a cross sectional view of the fixed conductor taken along line B—B of FIG. 3.

FIG. 5 is a cross sectional view of the fixed conductor 12 taken along line B—B of FIG. 3. As shown in FIG. 5, the fixed conductor 12 is a semicylindrical member, which is provided with the exhaust port 18 on the downstream side of a flow of insulating gas and which is smaller in cross-section parallel to the axis thereof on the downstream side of the flow of insulating gas. In addition, the fixed conductor 12 is provided with the semicylindrical shield 14. Both side portions, in the longitudinal direction, of a cylindrical portion of the semicylindrical shield 14 are each joined to both side portions of the opening side of the semicylindrical member on the upstream side of the flow of insulating gas. Moreover, the semicylindrical shield 14 is provided with two semispherical end shields 13 having their distal end closed on the downstream side of the flow of insulating gas.

The fixed conductor 12 includes three stages, i.e., an upstream part, an intermediate part, and a downstream part with respect to the flow of insulating gas in cross-section parallel to the axis of a barrel portion of the semicylindrical member. The intermediate part is smaller in cross-section on the downstream side thereof and is provided with the exhaust port 18.

The semicylindrical shields 14 are each joined to both side portions of the semicylindrical member of the fixed conductor 12 at the distal end thereof on the downstream side of the flow of insulating gas. The semicylindrical shield 14 is provided over a portion extending from the fixed side of the semicylindrical fixed conductor 12 to the intermediate part thereof.

Figure 6:
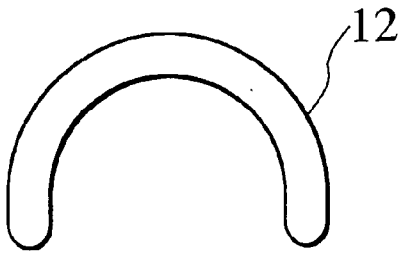
FIG. 6 is a cross sectional view of the fixed conductor along line C—C of FIG. 3.

FIG. 6 is a cross sectional view showing an end portion of the above-mentioned fixed conductor 12 on the downstream side of the flow of insulating gas. The end portion 22 is semicircular, and extends longer in a circumferential length than the semicylindrical barrel portion of the fixed conductor 12.

Since the semicylindrical shield 14 of the present invention is formed as described above, the flow of heat gas is adjusted in such a manner as not to diffuse to ground. Using the semicylindrical shield 14 made of, for example, a copper material excellent in thermal conductivity, provides a cooling effect. In addition, since the semicylindrical shield 14 is in a shield shape, a local concentration of the electric field can be buffered to suppress a deterioration of insulation due to a flow of heat gas upon interruption of a large current, which improves ground insulating performance. Moreover, since the heat gas can be exhausted from the arc-extinct chamber 1 without staying there, the pole-to-pole insulating performance can be improved. Furthermore, large current interruption performance can be improved and the sized of a tank can be reduced.

In a gas-blasted circuit-breaker according to the present invention, since a fixed conductor has a specific structure and a shield having a specific structure effective in adjusting a flow of heat gas is provided, insulating performance relating to the flow of heat gas produced upon interruption of a large current can be improved. Since at least part of a conductor is provided with a hole passing therethrough, a heat gas flowing inside the fixed conductor can be exhausted efficiently.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A gas-blasted circuit-breaker comprising:

a movable arc contact;

a fixed arc contact opposed to the movable arc contact;

an insulating nozzle disposed at the movable arc contact on the fixed arc contact side thereof;

a puffer cylinder disposed on the side opposite to the insulating nozzle;

a hollow conductor that holds the fixed arc contact opposed to the insulating nozzle;

an insulating rod connected to the puffer cylinder; and a fixed piston fitted inside the puffer cylinder;

wherein an insulating gas is ejected to a space between the puffer cylinder and the fixed piston by driving the insulating rod and is sprayed to an arc generated upon interruption of a current; and wherein the hollow conductor is in a cylindrical shape having a cross section parallel to the axis thereof, the cross section being smaller in diameter on the downstream side of a flow of insulating gas, the hollow conductor having a closed end on the downstream side of the flow of insulating gas, and the hollow conductor has a cylindrical barrel portion provided with a plurality of openings.

2. A gas-blasted circuit-breaker according to claim 1, wherein the cylindrical barrel portion has three stages of an upstream part, an intermediate part, and a downstream part with respect to the flow of insulating gas in a cross-section parallel to the axis thereof, and the intermediate part is made progressively smaller toward the downstream side thereof and is provided with the openings.

3. A gas-blasted circuit-breaker comprising:

a movable arc contact;

a fixed arc contact opposed to the movable arc contact;

an insulating nozzle disposed at the movable arc contact on the fixed arc contact side thereof;

a puffer cylinder disposed on the side opposite to the insulating nozzle;

a conductor secured to the fixed arc contact opposed to the insulating nozzle;

an insulating rod connected to the puffer cylinder; and a fixed piston fitted inside the puffer cylinder;

wherein an insulating gas is ejected to a space between the puffer cylinder and the fixed piston by driving the insulating rod and is sprayed to an arc generated upon interruption of a current; and wherein the conductor includes a semicylindrical member having an opening on the downstream side of a flow of insulating gas and a cross-section being parallel to the axis of the conductor and being smaller on the downstream side of the flow of insulating gas, and a semicylindrical shield member that is joined to both side portions of the opening side of the semicylindrical member on the side portions of a cylindrical portion of the semicylindrical shield member in the longitudinal direction thereof on the upstream side of the flow of insulating gas, and the semicylindrical shield member has a shape in which the distal end thereof on the downstream side of the flow of insulating gas is closed.

4. A gas-blasted circuit-breaker according to claim 3, wherein a barrel portion of the semicylindrical member has three stages of an upstream part, an intermediate part and a downstream part with respect to the flow of insulating gas in cross-section parallel to the axis thereof, and the intermediate part is smaller in cross-section on the downstream side thereof and is provided with the opening.

5. A gas-blasted circuit-breaker according to claim 3, the semicylindrical shield is joined to the semicylindrical member at the distal end thereof on the downstream side of the flow of insulating gas.

6. A gas-blasted circuit-breaker according to claim 3, wherein the semicylindrical shield member is provided over a portion extending from the fixed side of the semicylindrical member to the intermediate part thereof.

7. A gas-blasted circuit-breaker according to claim 3, wherein the semicylindrical member has a semispherical distal end on the downstream side of the flow of insulating gas.

* * * * *